US008330390B2

(12) United States Patent
Hum et al.

(10) Patent No.: US 8,330,390 B2
(45) Date of Patent: Dec. 11, 2012

(54) AC LED LIGHT SOURCE WITH REDUCED FLICKER

(75) Inventors: David Hum, Livermore, CA (US); Steven D. Lester, Livermore, CA (US)

(73) Assignee: Bridgelux, Inc., Livermore, CA (US)

( * ) Notice: Subject to any disclaimer, the term of this patent is extended or adjusted under 35 U.S.C. 154(b) by 0 days.

(21) Appl. No.: 13/084,331

(22) Filed: Apr. 11, 2011

(65) Prior Publication Data

US 2012/0133289 A1 May 31, 2012

(51) Int. Cl.
*G05F 1/00* (2006.01)

(52) U.S. Cl. ..... 315/294; 315/307

(58) Field of Classification Search ..... 315/291, 315/307, 312, 294, 297, 216; 345/211, 212; 362/612, 613, 800
See application file for complete search history.

(56) References Cited

U.S. PATENT DOCUMENTS 7,781,979 B2 * 8/2010 Lys ..... 315/185 S
7,808,460 B2 * 10/2010 Nakajima ..... 345/82

* cited by examiner

*Primary Examiner* — Minh D A
(74) *Attorney, Agent, or Firm* — Calvin B. Ward

(57) ABSTRACT

A lighting apparatus and method for operating LED-based lighting devices are disclosed. The apparatus includes a receiver that receives a potential from a power source whose output varies as a function of time, an energy storage device, and an LED array. The energy storage device stores energy from the power source when the driving potential is greater than a predetermined value. The LED array has variable forward bias potential, the LED array generating light when a potential across the array is greater than the selected forward bias potential. A source selector connects the energy storage device to the array when the potential from the power source is less than a predetermined value. A controller that varies the forward bias potential such that the difference between the forward bias potential and potential across the array is maintained at a value less than a predetermined value.

18 Claims, 7 Drawing Sheets

AC LED LIGHT SOURCE WITH REDUCED FLICKER

BACKGROUND OF THE INVENTION

Light emitting diodes (LEDs) are an important class of solid-state devices that convert electric energy to light. Improvements in these devices have resulted in their use in light fixtures designed to replace conventional incandescent and fluorescent light sources. The LEDs have significantly longer lifetimes and, in some cases, significantly higher efficiency for converting electric energy to light.

The conversion efficiency of individual LEDs is an important factor in addressing the cost of high power LED light sources. The conversion efficiency of an LED is defined to be the electrical power dissipated per unit of light that is emitted by the LED. Electrical power that is not converted to light in the LED is converted to heat that raises the temperature of the LED. The light conversion efficiency of an LED decreases with increasing current through the LED.

LEDs are typically powered from a DC power source or a modulated square wave source so that a constant current flows through the LED while the LED is "on". The current is set to provide high efficiency. In light sources with variable intensity, the intensity of the light is controlled by changing the duty factor of the modulated square wave so that the current flowing through the LED is at a value consistent with providing the desired efficiency.

Conventional lighting systems typically must be powered from an AC power source. Hence, an LED-based light source typically includes an AC-DC power converter. The cost of the power converter represents a significant fraction of the cost of a typical LED light source. In addition, the power losses in the power converter reduce the overall efficiency of the light source.

To avoid these costs, LED light sources that operate directly from an AC power source without the power first being converted to DC have been proposed. Such light sources typically include two strings of LEDs. The LEDs are connected in series in each string. One string is powered on when the AC waveform is in the positive half of the sine wave, and the other is powered when the AC waveform is in the negative half of the sine wave.

This simple driving scheme suffers from low efficiency and flicker. Consider a single LED that is driven by an AC waveform. In general, the LED is characterized by a minimum voltage that must be applied to forward bias the LED so that a current will flow through the LED. During the half of the AC cycle in which the diode is forward biased, the LED will remain off until the sine wave reaches this voltage. During the portion of the sine wave in which the LED is on, the average current must be set to the optimum current from a power efficiency point of view. Hence, during a portion of the cycle, the current will be higher than the optimum power, and the efficiency of the LED will be reduced. During the portion of the sine wave in which the voltage is less than that required to turn on the LED, the LED will be dark. This gives rise to a flicker in the intensity at a frequency that is twice the frequency of the AC light source.

In a co-pending application, U.S. Ser. No. 12/504,994, filed on Jul. 17, 2009, an improved AC LED light source is described in which each LED in a series string is connected in parallel with a switch that shorts that LED when the AC voltage across the string is insufficient to drive all of the LEDs in the string. In this manner, the LEDs that remain are driven with a current more nearly equal to the optimum current, and hence, the efficiency losses described above are reduced.

While this arrangement improves the overall conversion efficiency, the resultant light source still suffers from flicker. In addition, the average number of LEDs that are powered over the AC voltage cycle is low, and hence, the number of LEDs needed to provide a predetermined light output is increased relative to DC driven LED light sources.

SUMMARY OF THE INVENTION

The present invention includes a lighting apparatus and method for operating LED based lighting devices. The apparatus includes a receiver that receives a potential from a power source whose output varies as a function of time, an energy storage device, and an LED array. The energy storage device stores energy from the power source when the driving potential is greater than a predetermined value. The LED array is characterized by a forward bias potential having a plurality of different selectable values, the LED array generating light when a potential between first and second power terminals is greater than the selected forward bias potential. A source selector connects the energy storage device to the first and second power terminals when the potential from the power source is less than a predetermined value. A controller that varies the forward bias potential such that the difference between the forward bias potential and the potential between the first and second terminals at any given time is less than a predetermined value.

DETAILED DESCRIPTION OF THE PREFERRED EMBODIMENTS OF THE INVENTION

Normally, LEDs are driven by a constant current source to prevent damage to the LED that operates from a DC power supply. As noted above, the cost of the power source represents a significant portion of the overall cost of the light source. To avoid this cost, it has been suggested that LEDs could be operated from any AC power source. In such a scheme, a full wave rectified AC power source is connected directly to the LED. Hence, the LED is driven by a power source that is no longer a constant current source. Since the current through an LED is an exponential function of the driving voltage at voltages above the minimum voltage at which the LED will be turned on, care must be taken to make sure that the voltage does not reach a point at which the current through the LED will cause damage to the LED. In addition, it is useful to maintain the current below that at which the efficiency of the LED is reduced and too much heat is generated.

Figure 1:
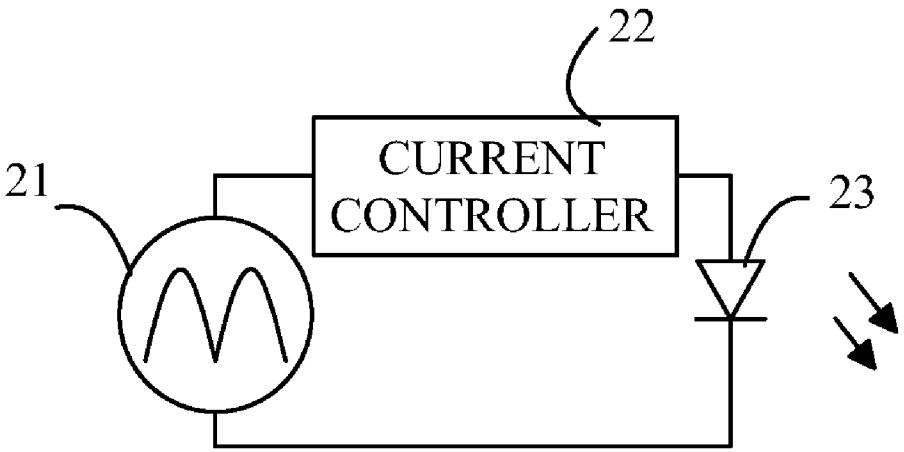
FIGURE 1 (PRIOR ART)
FIG. 1 illustrates an LED driven by a full wave rectified power source.
Figure 2:
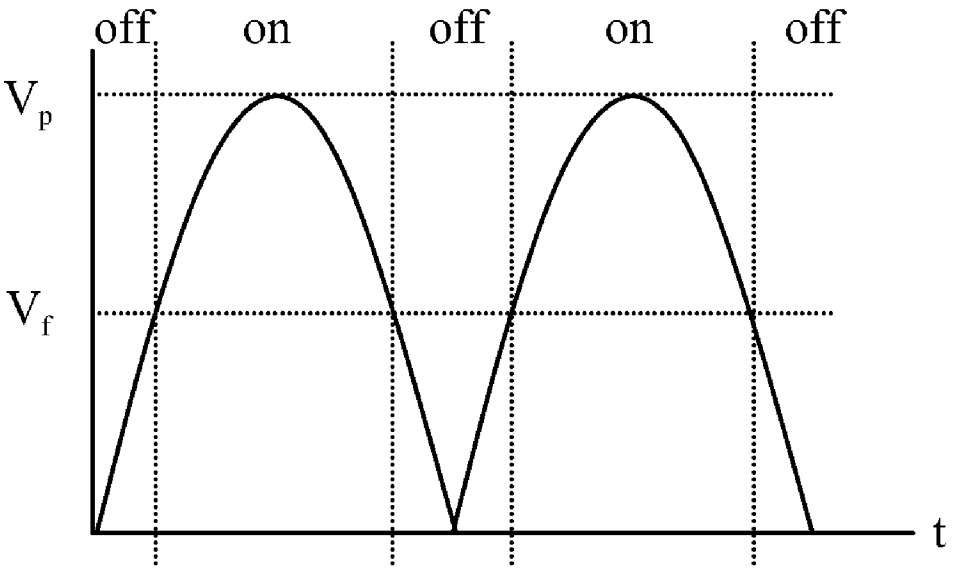
FIGURE 2 (PRIOR ART)
FIG. 2 illustrates two cycles of the full wave rectified power source.

Referring now to FIG. 1, which illustrates an LED 23 driven by a full wave rectified power source 21. Two cycles of the full wave rectified power source are shown in FIG. 2. In general, LED 23 is characterized by a minimum forward voltage value, $V_f$, at which the LED passes current and generates light. Since the current through an LED like any other diode increases exponentially with the voltage across the diode above this minimum voltage, a current controller 22 is typically utilized to prevent the current through the LED from reaching a value that would destroy the LED direct operation. In operation, the LED is operated with a voltage across the LED which is slightly higher than $V_f$. It should be noted that the value of $V_f$ can be altered by connecting a number of LEDs in series to produce an LED that effectively has a higher $V_f$.

Refer now to FIG. 2. The LED will generate light when the voltage of the waveform is greater than $V_f$. At the points in the power cycle in which the voltage of the driving waveform is less than $V_f$, no light is generated, and hence, the light source flickers. The amount of time that the light source is off depends on the relative values of $V_P$ and $V_f$. Increasing $V_p$ relative to $V_f$ lowers the fraction of the time that the light source is off. However this leads to wasted power since the voltage that is not applied across the LED appears across the current controller 51. The power that is not converted in the LED is converted to heat in the current controller. Hence, increasing $V_p$ relative to $V_f$ to increase the fraction of the time the light source is on leads to significant power losses.

Figure 3:
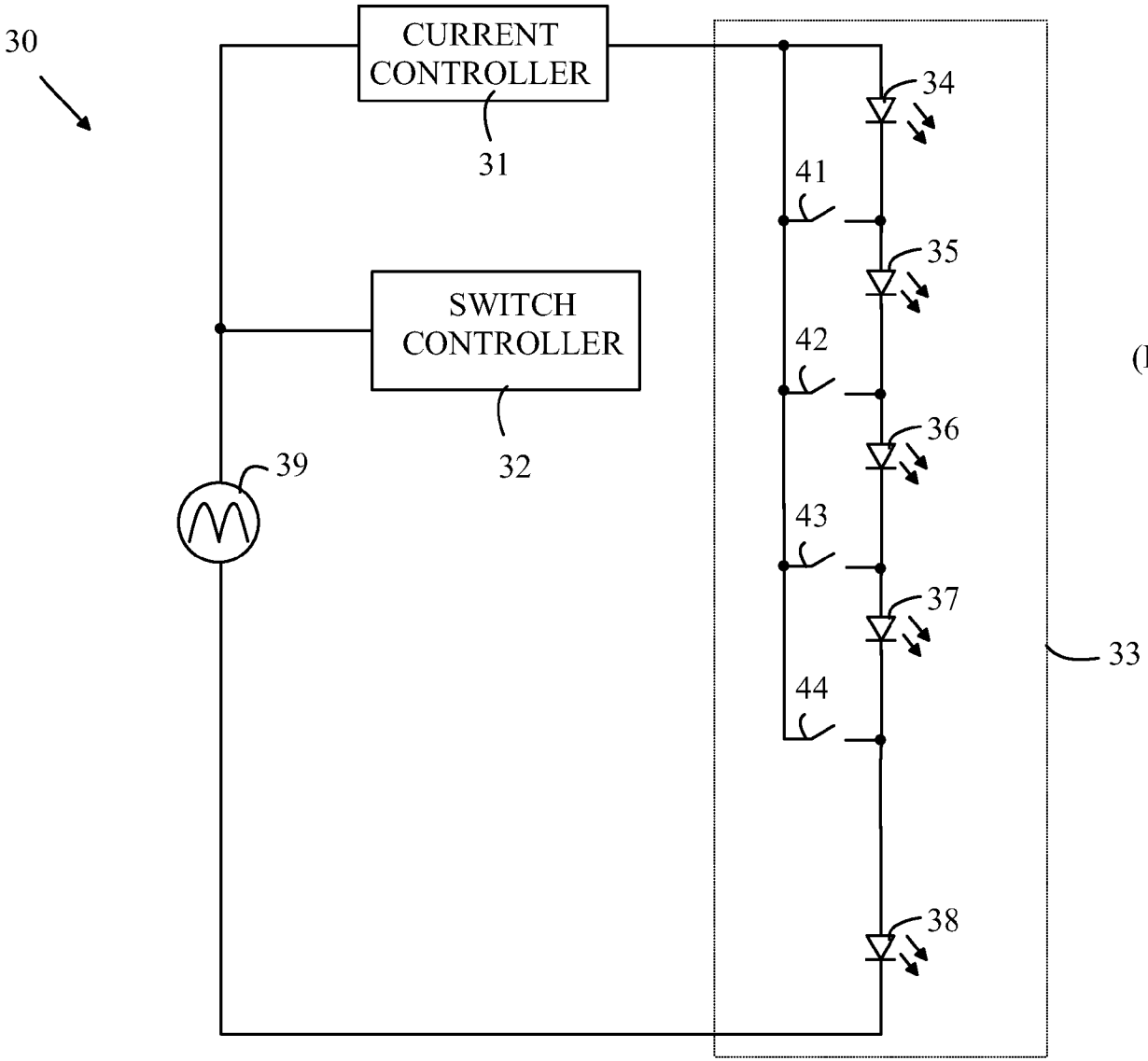
FIGURE 3 (PRIOR ART)
FIG. 3 illustrates a series connected string of LEDs with shorting switches.

In the above identified co-pending application, a scheme that reduces these power losses is described. In one of these embodiments, the LED shown in FIG. 2 is replaced by a series connected string of LEDs with shorting switches that effectively remove LEDs from the string in response to the drops in the power voltage of the AC waveform. Referring now to FIG. 3, which is a schematic drawing of a light source 30 that utilizes such an arrangement. A series connected string of LEDs 33 is powered from a fully rectified AC source 39 through a current controller 31. In the embodiment shown in FIG. 3, the series connected string of LEDs consists of five LEDs shown at 34 through 38. A number of shorting switches shown at 41 through 43 are used to control which LEDs in the string are active at any given time. For example if shorting switch 41 is closed, LED 34 is no longer powered. Similarly if shorting switch 42 is closed, LEDs 34 and 35 are no longer powered. A switch controller 32 controls which of the switches are activated at any given time based on the voltage of the waveform from its source 39.

In operation, the switches are operated as follows. When the voltage from source 39 is less than two $V_f$, switch 44 is closed and the remaining switches are in the open position. As the voltage increases about two $V_f$, switch 44 is opened and switch 43 closes thereby applying the voltage across LEDs 37 and 38. When the voltage increases further to at least three $V_f$, switch 42 is closed and the remaining switches are set in the open position and hence the voltage is applied across LEDs 36, 37, and 38. This process continues until the voltage from source 39 is greater than five $V_f$. At this point, all of the switches are open and the voltage appears across the entire series string of LEDs. As the voltage decreases from its peak voltage, the process is repeated in reverse.

Figure 4:
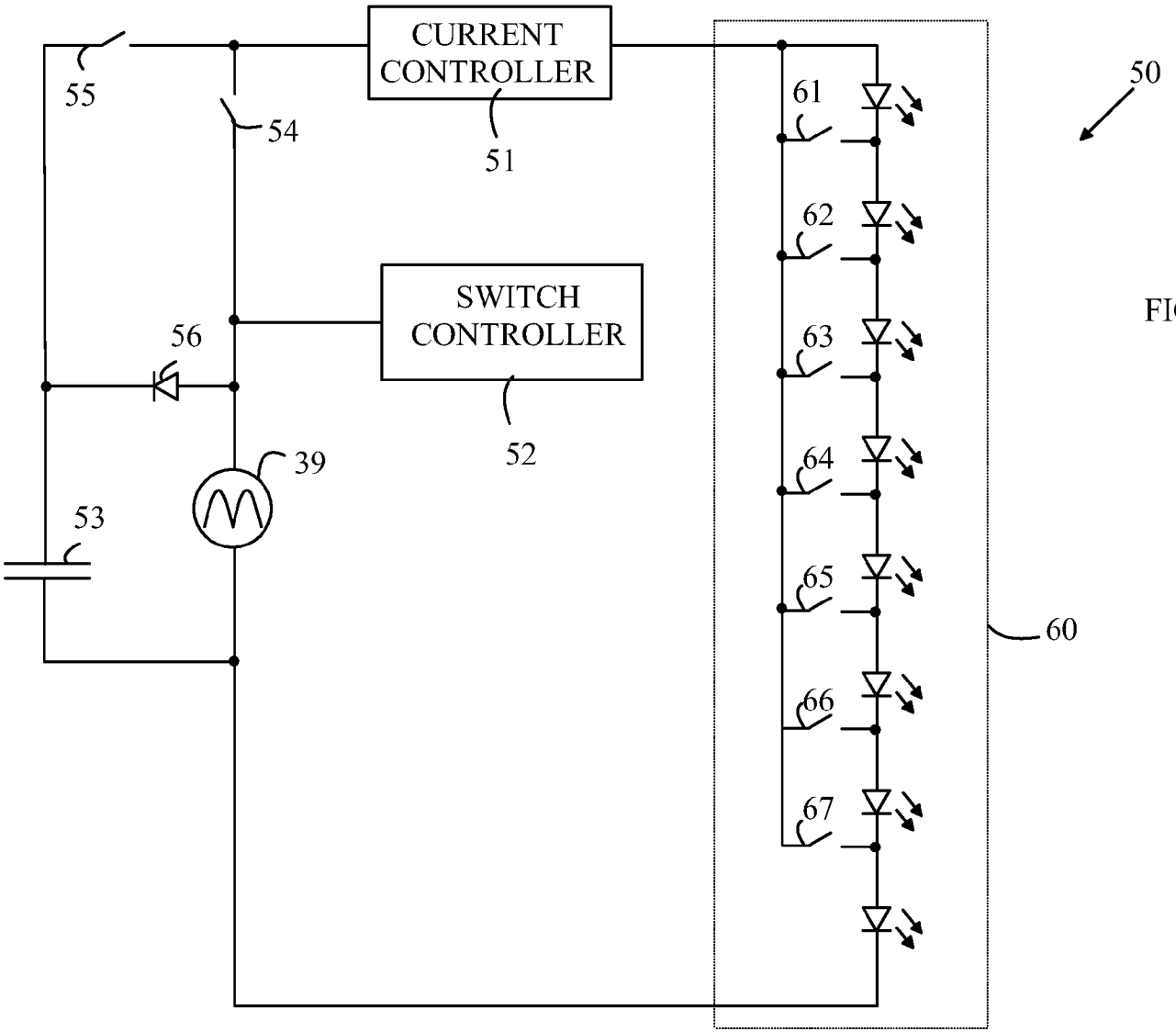
FIG. 4 illustrates a light source according to one embodiment of the present invention.

The embodiment shown in FIG. 3 suffers from flicker. When the voltage from the light source is less than $V_f$, none of the LEDs are turned on. The fraction of the time that the light source is off depends on the ratio of the peak voltage from voltage source 39 to $V_f$. Consider the case in which the peak voltage is eight times $V_f$ and the AC power source is a full wave rectified version of conventional 60 cycle AC. In this case the light source will be off for approximately 0.6 ms of each 8.3 ms cycle. Refer now to FIG. 4, which illustrates a light source according to one embodiment of the present invention. Light source 50 includes a capacitor 53 for storing power acquired during the peak voltage of source 39 for use in powering the LEDs when the voltage from source 39 is too small to provide power. When the LEDs are powered from source 39 directly, switch 55 is open and switch 54 is closed. The peak voltage of source 39 is captured on capacitor 53 by a diode 56. When switch controller 52 determines that the voltage from source 39 is less than $V_f$, switch 54 is opened and switch 55 is closed. In addition, switches 61-67 are all opened at this point. These switches are closed in sequence as the potential on capacitor 53 is depleted by the current flowing through the LEDs.

Denote the number of LEDs in the series connected string by N. In the example shown in FIG. 4, N is eight. The amount of charge that can be stored on capacitor 53 depends on the capacitance value and the voltage to which capacitor 53 is charged. The peak voltage from source 39 is approximately $NV_f$. When the voltage on capacitor 53 reaches $V_f$, no further charge will flow through the current controller into the LED string. Hence, the useful charge stored on capacitor 53 is $(N-1)V_f$ times the capacitance of capacitor 53. This charge provides the current for running string 60 during the period of time that source 39 outputs insufficient voltage to power string 60. Consider an embodiment in which the peak voltage of source 39 is 120 V and in which the number of LEDs in string 60 is eight. In this case, $V_f$ would need to be 15 V. An LED with a 15 V $V_f$ can be constructed by connecting five LEDs in series each with their $V_f$ of 3 V. Assume that the LEDs are sized to draw 100 mA. Hence, capacitor 53 must store sufficient charge to provide 100 mA for 0.6 ms. The charge in question is equal to 60 μC. The required capacitance is hence 0.6 μF. Such capacitors can be easily fabricated on the silicon substrate used to fabricate the switches. If the capacitance of capacitor 53 is increased to approximately 1.5 μF, and if the power supply is switched to the capacitor when the voltage falls below two times $V_f$, then at least two LEDs will remain lit throughout the cycle.

Figure 5:
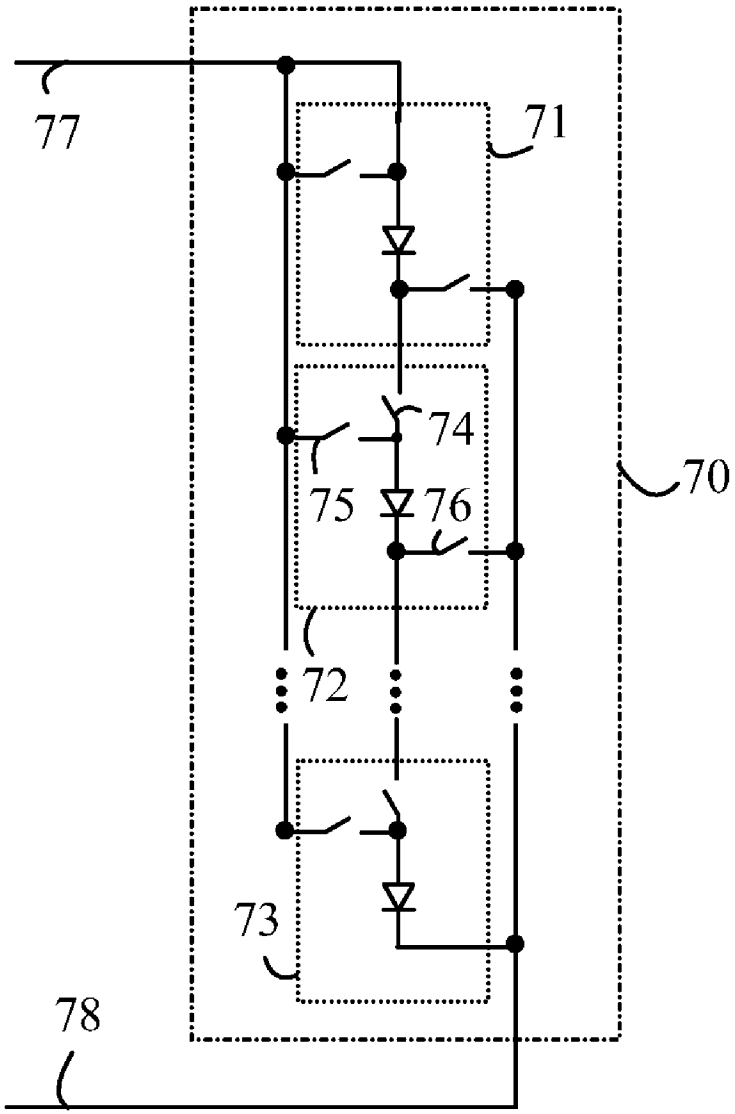
FIG. 5 illustrates one embodiment of a reconfigurable LED array according to the present invention.

While the above embodiments significantly reduce flickering by ensuring that at least one or two LEDs are powered at all times, there are still variations in the light output over the cycle of the input AC waveform. These variations can be further reduced by replacing the series connected string of LEDs shown in FIG. 4 with a reconfigurable string of LEDs. Refer now to FIG. 5, which illustrates one embodiment of a reconfigurable LED array according to the present invention. Array 70 is constructed from a plurality of LED sections that include a first LED section 71, one or more intermediate LED sections 72, and a third LED section 73.

Each of the intermediate sections 72 includes one LED and three switches. Switch 75 allows the anode of the LEDs to be connected to power bus 77. Switch 76 allows the cathode of the LED to be connected to power bus 78. Switch 74 allows the anode of the LED to be connected to the cathode of the LED adjacent to it in the string. The initial section 71 lacks switch 74. Similarly the last section 73 lacks switch 76.

Figures 6A, 6B, 6C, 6D, 6E:
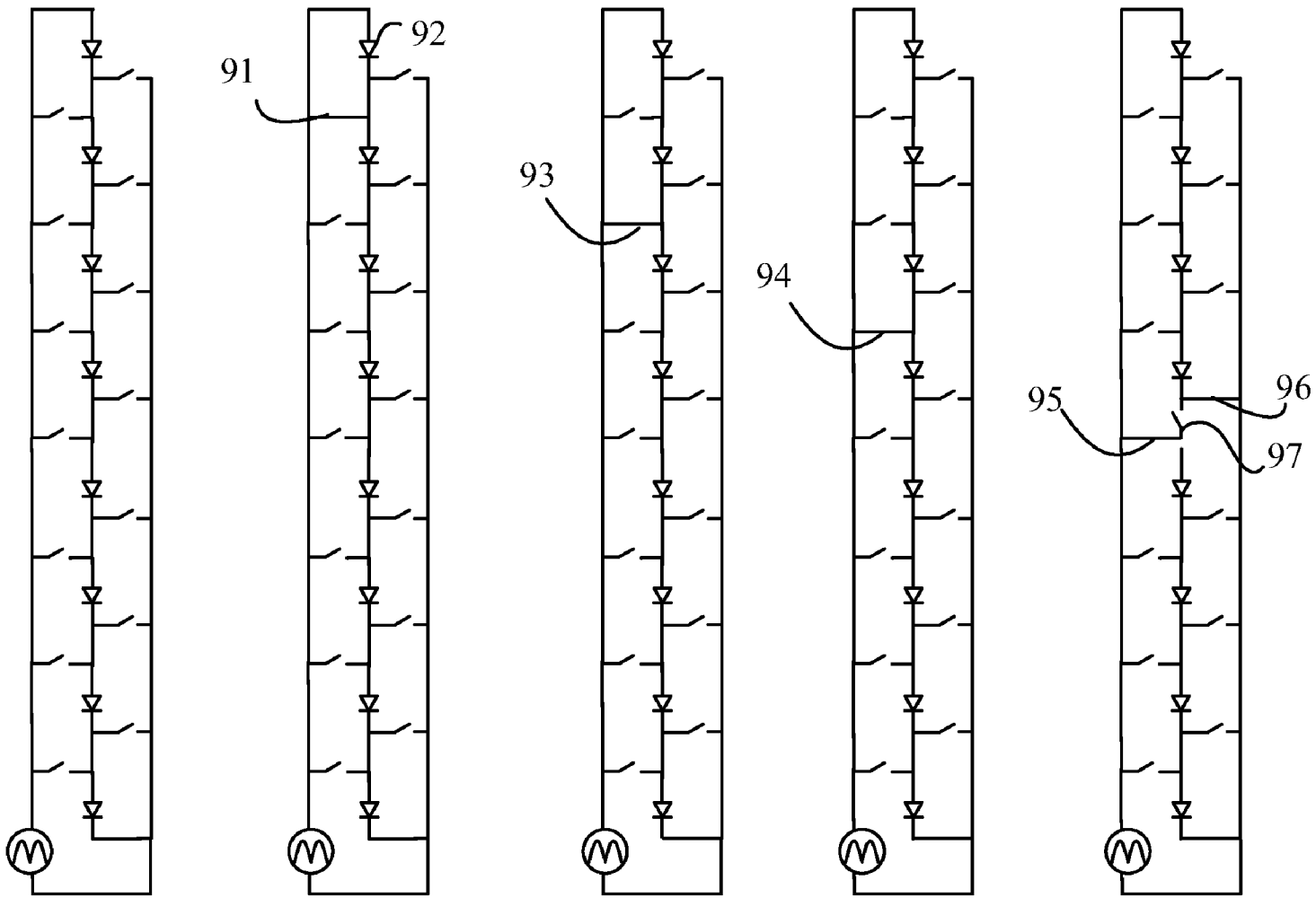
FIGS. 6A-6H illustrate the pattern of switching used in the case in which the number of LEDs is eight.

The various switches are operated by a switch controller analogous to that described above. By appropriately setting the switches in the array, the array can be configured as a plurality of series connected LED strings that are operated in parallel or a single LED string having a variable number of LEDs that are connected in series. In one aspect of the invention, the number of LEDs in the array is a power of two. Refer now to FIGS. 6A-6H, which illustrate the pattern of switching used in the case in which the number of LEDs is eight. To simplify the drawings, the current controller switch controller and energy storage sections discussed above have been omitted. Refer now to FIG. 6A, which illustrates the switch positions when the voltage from the voltage source is sufficient to power all eight LEDs. In this case the LEDs are connected as a single string of eight LEDs in series. When the voltage drops to the point at which eight LEDs can no longer be powered, switch 91 is closed thereby eliminating LED 92 from the string as shown in FIG. 6B. Similarly, when the voltage from the voltage source no longer supports seven LEDs, switch 93 is closed as shown in FIG. 6C thereby configuring the string as six LEDs in series. When the voltage from the source drops further so that six LEDs can no longer be supported, switch 94 is closed as shown in FIG. 6D leaving the string configured as five LEDs in series.

When the voltage source can no longer support five LEDs in series, the array is reconfigured to provide two sets of four LEDs in series that are driven in parallel as shown in FIG. 6E. This reconfiguration is accomplished by closing switches 95 and 96 and opening switch 97. Accordingly, the number of LEDs that are generating light increases from five back to eight.

Figure 6H:
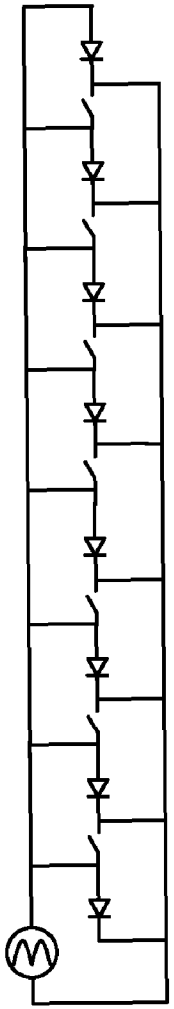
Figure 6G:
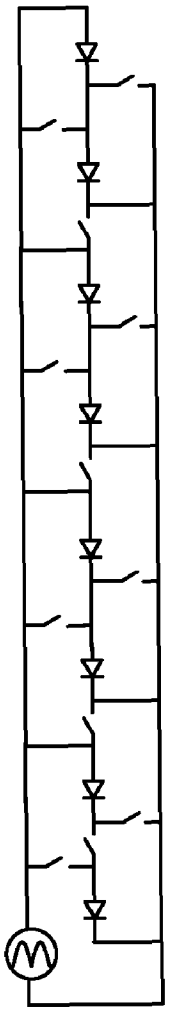
Figure 6F:
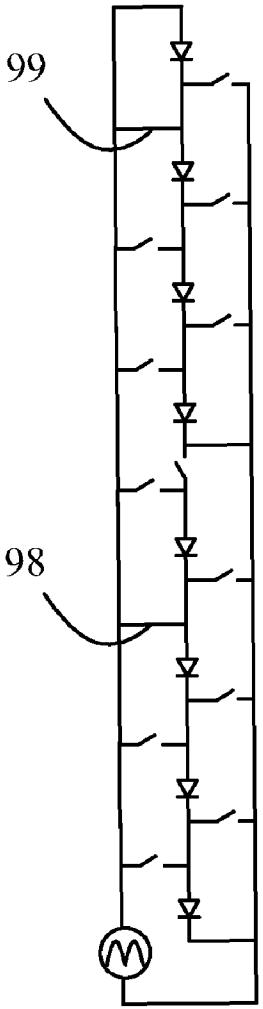

When the voltage source can no longer support four LEDs in series, the array is reconfigured to provide two sets of three LEDs in series that are driven in parallel as shown in FIG. 6F. This is accomplished by closing switches 98 and 99 and opening switch 95. At this point the number of LEDs that are generating light decreases to six.

When the voltage source can no longer support three LEDs in series, the array is reconfigured to provide four sets of two LEDs in series that are driven in parallel as shown in FIG. 6G. Hence, the number of LEDs that are generating light increases back to eight. When the voltage source will no longer support two LEDs in series, the array is reconfigured to provide eight LEDs that are driven in parallel as shown in FIG. 6H. Hence the number of LEDs that are generating light remains at eight. Finally, when the voltage source can no longer support one LED, the full wave rectified source is replaced by the capacitive source discussed above and the array is configured to provide eight LEDs in series as shown in FIG. 4. During the time period in which the LEDs are driven up capacitor 53, the string is operated as discussed with respect to the embodiment shown in FIG. 4. That is, the string is not reconfigured to provide parallel strings during the period of time that it is driven from the capacitive source 53.

Figure 7:
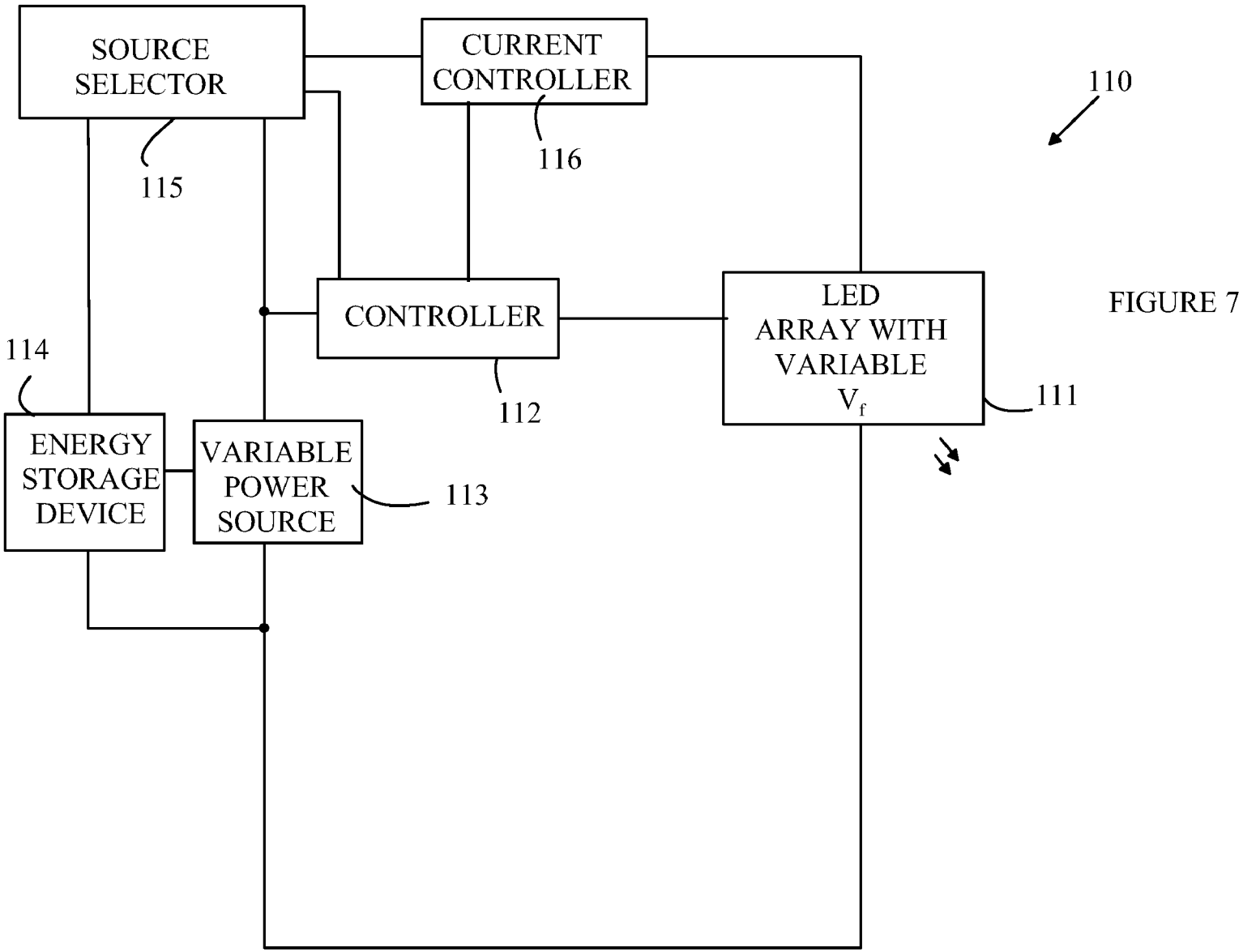
FIG. 7 illustrates another embodiment of a light source according to the present invention.

The above described embodiments of the present invention utilize particular configurations of LED arrays and a particular storage device. However other forms of storage devices and other forms of LED arrays could be utilized. Refer now to FIG. 7, which illustrates another embodiment of a light source according to the present invention. Light source 110 utilizes an LED array that has a forward bias potential that is selected by a control signal from controller 112. Any arrangement of LEDs and switches that provide a forward bias potential that can be changed over time can be utilized.

Light source 110 utilizes a variable power source 113 in which the output power varies as a function of time. This variation may be sinusoidal as described above or any other voltage waveform that has a maximum potential which is greater than the maximum forward bias potential of the LED array and a minimum output potential which is less than the minimum forward bias potential that is selectable by controller 112.

An energy storage device 114 stores energy from variable power source 113 when the output potential from variable power source 113 is greater than some predetermined value. In the embodiment shown above, energy storage device 114 utilizes a capacitor that is charged to the potential at the maximum value of the output potential of variable power source 113. However, other devices could be utilized. For example, energy storage device 114 could include a small rechargeable battery.

A source selector 115 switches between the variable power source 113 and the output of the energy storage device 114 to provide power to LED array 111. In one aspect of the invention, controller 112 switches power sources when the output of variable power source 113 can no longer provide power at a potential above the minimum value of the forward bias potential of LED array 111.

Current controller 116 is used to maintain the voltage across LED array 111 and a value such that the LEDs are protected from overload. The current provided to LED array 111 may depend on the specific value of the forward bias potential that is currently selected. For example, if LED array 111 is reconfigured from a series string of LEDs to two strings of LEDs driven in parallel, current controller 116 must then increase the current available to LED array 111 to supply the additional current needed to drive the team strings in parallel. In the embodiment shown in FIG. 7, controller 112 also controls the current controller such that the current is consistent with the current needed to drive LED array 111.

The above-described embodiments of the present invention have been provided to illustrate various aspects of the invention. However, it is to be understood that different aspects of the present invention that are shown in different specific embodiments can be combined to provide other embodiments of the present invention. In addition, various modifications to the present invention will become apparent from the foregoing description and accompanying drawings. Accordingly, the present invention is to be limited solely by the scope of the following claims.

What is claimed is:

1. An apparatus comprising:

a power coupler that receives a driving potential from a power source that varies as a function of time;

an energy storage device that stores energy from said power source when said driving potential is greater than a predetermined value;

an LED array having a forward bias potential having a plurality of different selectable values, said LED array generating light when a potential between first and second power terminals is greater than said selected forward bias potential;

a source selector that connects said energy storage device to said first and second power terminals when said potential from said power source is less than a predetermined value; and a controller that varies said forward bias potential such that the difference between said forward bias potential and said potential between said first and second power terminals is less than a predetermined value.

2. The apparatus of claim 1 comprising a current controller that regulates a current passing through said LED array when said potential is greater than said forward bias potential to maintain said current at a value less than a predetermined current value.

3. The apparatus of claim 2 wherein said controller increases said forward bias potential when said current passing through said LED array is greater than said predetermined current value.

4. The apparatus of claim 1 wherein said power source comprises a rectified AC power source.

5. The apparatus of claim 1 wherein said energy storage device comprises a capacitor that is charged from said power source.

6. The apparatus of claim 1 wherein said LED array comprises a plurality of LEDs and a switching network for configuring said LEDs in different connection arrangements, at least one of said connection arrangements having a forward bias potential that is different from another of said connection arrangements.

7. The apparatus of claim 6 where one of said connection arrangements comprises a plurality of LEDs connected in series.

8. The apparatus of claim 6 wherein one of said connection arrangements comprises a plurality of LED strings connected in parallel, each LED string comprising a plurality of LEDs connected in series.

9. The apparatus of claim 1 wherein said controller reduces said forward bias potential when said current passing through said array is less than a predetermined value.

10. A method for operating a light source comprising:

receiving power from a power source that provides a driving potential that varies as a function of time;

storing energy from said power source in an energy storage device when said driving potential is greater than a predetermined value;

providing an LED array having a forward bias potential having a plurality of different selectable values, said LED array generating light when a potential between first and second power terminals is greater than said forward bias potential;

connecting said energy storage device to said first and second power terminals when said potential from said power source is less than a predetermined value; and varying said forward bias potential such that the difference between said forward bias potential and said potential between said first and second power terminals is less than a predetermined value.

11. The method of claim 10 regulating a current passing through said LED array when said potential is greater than said forward bias potential to maintain said current at a value less than a predetermined current value.

12. The method of claim 11 wherein said forward bias potential is increased when said current passing through said LED array is greater than said predetermined current value.

13. The method of claim 10 wherein said power source comprises a rectified AC power source.

14. The method of claim 10 wherein said energy storage device comprises a capacitor that is charged from said power source.

15. The method of claim 10 wherein said LED array comprises a plurality of LEDs and a switching network for configuring said LEDs in different connection arrangements, at least one of said connection arrangements having a forward bias potential that is different from another of said connection arrangements, and wherein varying said forward bias potential comprises changing said switching network.

16. The method of claim 15 where one of said connection arrangements comprises a plurality of LEDs connected in series.

17. The method of claim 15 wherein one of said connection arrangements comprises a plurality of LED strings connected in parallel, each LED string comprising a plurality of LEDs connected in series.

18. The method of claim 10 wherein said forward bias potential is reduced when said current passing through said LED array is less than a predetermined value.

* * * * *